US007410326B2

(12) United States Patent
Morrison et al.

(10) Patent No.: US 7,410,326 B2
(45) Date of Patent: Aug. 12, 2008

(54) AUXILIARY REACTION FRAME SYSTEM FOR CANTILEVERED JACK-UP RIGS, AND METHOD THEREFORE

(76) Inventors: Marvin Lynn Morrison, 362 Holly Bay Cir., Hemphill, TX (US) 75948; Maxime Hugues Lefebvre, 249 Pasir Panjang Road #01-07, Singapore (SG) 118609

( * ) Notice: Subject to any disclaimer, the term of this patent is extended or adjusted under 35 U.S.C. 154(b) by 68 days.

(21) Appl. No.: 11/507,914

(22) Filed: Aug. 21, 2006

(65) Prior Publication Data

US 2008/0044234 A1 Feb. 21, 2008

(51) Int. Cl.
*E02B 17/00* (2006.01)

(52) U.S. Cl. ..... 405/201; 405/196

(58) Field of Classification Search ..... 405/195.1, 405/201; 114/264–266

See application file for complete search history.

(56) References Cited

U.S. PATENT DOCUMENTS

| | | | | |
|---|---|---|---|---|
| 194,974 | A | 9/1877 | Rathknecht | |
| 858,628 | A | 7/1907 | Ross | |
| 3,001,592 | A * | 9/1961 | Lucas | 405/201 |
| 3,001,594 | A | 9/1961 | Suderow | |
| 3,244,242 | A * | 4/1966 | Wolff | 405/201 |
| 3,477,235 | A | 11/1969 | Branham et al. | |
| 3,927,535 | A | 12/1975 | Giblon | |
| 4,290,495 | A | 9/1981 | Elliston | |
| 4,401,398 | A | 8/1983 | Remson | |
| 4,483,644 | A | 11/1984 | Johnson | |
| 4,668,127 | A | 5/1987 | Steele | |
| 4,823,870 | A | 4/1989 | Sorokan | |
| 4,913,591 | A | 4/1990 | Steele | |
| 4,973,198 | A | 11/1990 | Cox | |
| 5,248,003 | A | 9/1993 | Song et al. | |
| 6,030,148 | A | 2/2000 | Tormala et al. | |
| 6,048,135 | A | 4/2000 | Williford et al. | |
| 6,171,027 | B1 | 1/2001 | Blankestijin | |
| 6,390,732 | B1 | 5/2002 | Kristensen et al. | |
| 6,481,931 | B1 | 11/2002 | Welsh | |

* cited by examiner

*Primary Examiner*—Frederick L Lagman
(74) *Attorney, Agent, or Firm*—Joesph T Regard Ltd plc

(57) ABSTRACT

A retractable stern reaction frame for reinforcing self elevating platform cantilever beams. The preferred embodiment contemplates a support framework mounted on a self elevating platform transom and positioned to engage the cantilever to project the reaction point farther towards the cantilever reach. The frameworks are to be retractable (or portable) to allow the self elevating unit to position itself closer to the jackets than would otherwise be possible. The framework is designed to transmit the reaction forces back to the main deck, cantilever support bulkheads, inner bottom and bottom structure.

43 Claims, 8 Drawing Sheets

TYPICAL LOAD CHART BEFORE MODIFICATION

TRANSVERSE ENEVELOPE

| | | | | | | | | | |
|---|---|---|---|---|---|---|---|---|---|
| 100% | 100% | 95% | 92% | 76% | 60% | 49% | 40% | 33% | 26% |
| 100% | 100% | 100% | 97% | 90% | 77% | 66% | 55% | 45% | 34% |
| 100% | 100% | 100% | 100% | 97% | 89% | 76% | 64% | 54% | 42% |
| 100% | 100% | 100% | 100% | 100% | 98% | 88% | 76% | 65% | 48% |
| 100% | 100% | 100% | 100% | 100% | 100% | 99% | 89% | 77% | 52% |
| 100% | 100% | 100% | 100% | 100% | 100% | 100% | 100% | 92% | 65% |
| 100% | 100% | 100% | 100% | 100% | 100% | 99% | 89% | 77% | 52% |
| 100% | 100% | 100% | 100% | 100% | 98% | 88% | 76% | 65% | 48% |
| 100% | 100% | 100% | 100% | 97% | 89% | 76% | 64% | 54% | 42% |
| 100% | 100% | 100% | 97% | 90% | 77% | 66% | 55% | 45% | 34% |
| 100% | 100% | 95% | 92% | 76% | 60% | 49% | 40% | 33% | 26% |

LONGITUDINAL ENEVELOPE

FIG. 5A

IMPROVED LOAD CHART AFTER MODIFICATION

FULL LOAD RATING GAIN

TRANSVERSE ENEVELOPE

| | | | | | | | | | |
|---|---|---|---|---|---|---|---|---|---|
| 100% | 100% | 100% | 100% | 100% | 100% | 100% | 95% | 92% | 76% |
| 100% | 100% | 100% | 100% | 100% | 100% | 100% | 100% | 97% | 90% |
| 100% | 100% | 100% | 100% | 100% | 100% | 100% | 100% | 100% | 97% |
| 100% | 100% | 100% | 100% | 100% | 100% | 100% | 100% | 100% | 100% |
| 100% | 100% | 100% | 100% | 100% | 100% | 100% | 100% | 100% | 100% |
| 100% | 100% | 100% | 100% | 100% | 100% | 100% | 100% | 100% | 100% |
| 100% | 100% | 100% | 100% | 100% | 100% | 100% | 100% | 100% | 100% |
| 100% | 100% | 100% | 100% | 100% | 100% | 100% | 100% | 100% | 100% |
| 100% | 100% | 100% | 100% | 100% | 100% | 100% | 100% | 100% | 97% |
| 100% | 100% | 100% | 100% | 100% | 100% | 100% | 100% | 97% | 90% |
| 100% | 100% | 100% | 100% | 100% | 100% | 100% | 95% | 92% | 76% |

LONGITUDINAL ENEVELOPE

FIG. 5B

AUXILIARY REACTION FRAME SYSTEM FOR CANTILEVERED JACK-UP RIGS, AND METHOD THEREFORE

BACKGROUND OF THE INVENTION

1. Field of the Invention

The present invention relates to structural supports, and particularly to a system for selectively enhancing the support configuration of cantilever beams on jack-up drilling units or the like.

2. Description of the Relevant Art

A major limitation with oil well drilling or work over activities involving jack-up units utilizing a platform jacket and cantilever beam is the reduced drilling load available, due to the outreach position of said cantilever beams.

In such systems, the drill-floor that carries the drilling derrick is typically supported by 2 independent beams via a substructure that forms the cantilever assembly. The drill-floor skids transversely, to reach the drilling template ports, and as a result of this movement, the drilling load is applied unequally on the two cantilever beams. Thus, maximum outreach and offset of the drill-floor are dictated by the allowable load limits of the beams.

To assist the operator, a chart specific to every vessel indicates the position of the floor in relation with the allowable drilling load, and on average, the maximum drilling load is achievable over a limited portion of the drilling envelope. Generally, when drilling over a platform jacket the cantilever works at a far outreach only where the drilling load is reduced.

Accordingly, the reduced drilling loads impose limitations on operations, the greater extent maximum drilling load being achievable only within the pre-established drilling envelope. Self elevating platforms (jack-ups) which have good load chart capabilities surely are preferred by operators in a competitive market.

SUMMARY OF THE INVENTION

It is an object of the present invention to provide a retractable auxiliary support to the cantilever beams of self elevating units such as jack-up units or the like.

Another object of the present invention is to provide additional supports mounted on the transom along the cantilever beam path so as to sustain positive reaction, provide additional support, and thereby improve the cantilever rated load charts.

Still another object of the present invention is to provide selectively deployable supports to an approximate reported length of approximately one third of the cantilever beam working envelope, a length to which generally would not be practical for a self elevating unit to have permanently installed, as it would reduce the ability to stand close by a platform jacket installation.

To achieve the above-mentioned objects a retractable or portable structure is secured on the transom of the vessel. Sound mechanical interface connections are provided to transmit the efforts of the portable structure onto the bottom and support bulkhead of the jack-up vessel. The horizontal efforts are transposed to the vessel at the upper end of the cantilever beam support bulkhead, and at the lower end to the inner bottom structure. The structure is retractable or portable for two reasons; first the auxiliary structures need to be out of the way for jacking operation where if deployed they would interfere with the jacket envelope, secondly if they are not required for a drilling program the associated added weight can be removed without any negative impact on the payload of the vessel.

By the present invention, the new reaction added to the cantilever support arrangement has a primary purpose of increasing the rated capacity of the cantilever beams on the farther outreaches of the drilling envelope. The rating is improved by reducing the overhanging extent of the beams, where the bending effort of the cantilever beam is reduced by the same ratio.

The auxiliary structure is equipped with a low friction reaction pad to interact with the cantilever beam and transmit purely the vertical reaction. The structure can be designed to withstand, totally or partially, the reaction load at that point, depending of the requirement. The total load reaction is achieved by engineering the structure, considering no load sharing with the transom reaction point.

Partial load reaction is obtained by designing the auxiliary structure to share the cantilever beam loading once a certain level of deflection is reached. Partial reaction can be computed for any given support arrangement, where the relation between deflection and load is proportional.

From the load rating gain, the benefits of the invention become useful in many aspects. This gain gives the ability to carry the full drill string load (set back load) throughout the drilling envelope, with adequate hook load in reserve. This gain can also allow the conductor tensioning to be achieved from the cantilever beam itself rather than from the transom of the vessel which is the common traditional method.

When the tensioning is provided from the cantilever beams the drilling operation for exploration becomes more flexible because the conductor tensioning is possible along the entire length of the drilling envelope. In addition, when exploration drilling is possible further away from the transom, more valuable deck space is made available because the cantilever leaves more of the main deck exposed.

The above and further objects, details and advantages or the present invention will become apparent from the following description of preferred embodiments thereof, when read in conjunction with the accompanying drawings.

BRIEF DESCRIPTION OF THE DRAWINGS

FIG. 5A shows sample load charts anticipated rating in relation with the drilling envelope, before implementation of the present invention.

FIG. 5B shows sample load charts anticipated rating in relation with the drilling envelope, after implementation of the present invention.

DETAILED DESCRIPTION OF THE PREFERRED EMBODIMENTS

The preferred embodiment of the present invention, contemplating a selectively deployable (i.e., retractable) reaction frame for self-elevating platforms utilizing cantilever beams, is described below with reference to the Figures. The utilization and deployment process of the present invention, as utilized in conjunction with a drilling unit, is also illustrated and discussed in detail, herein.

Figure 1:
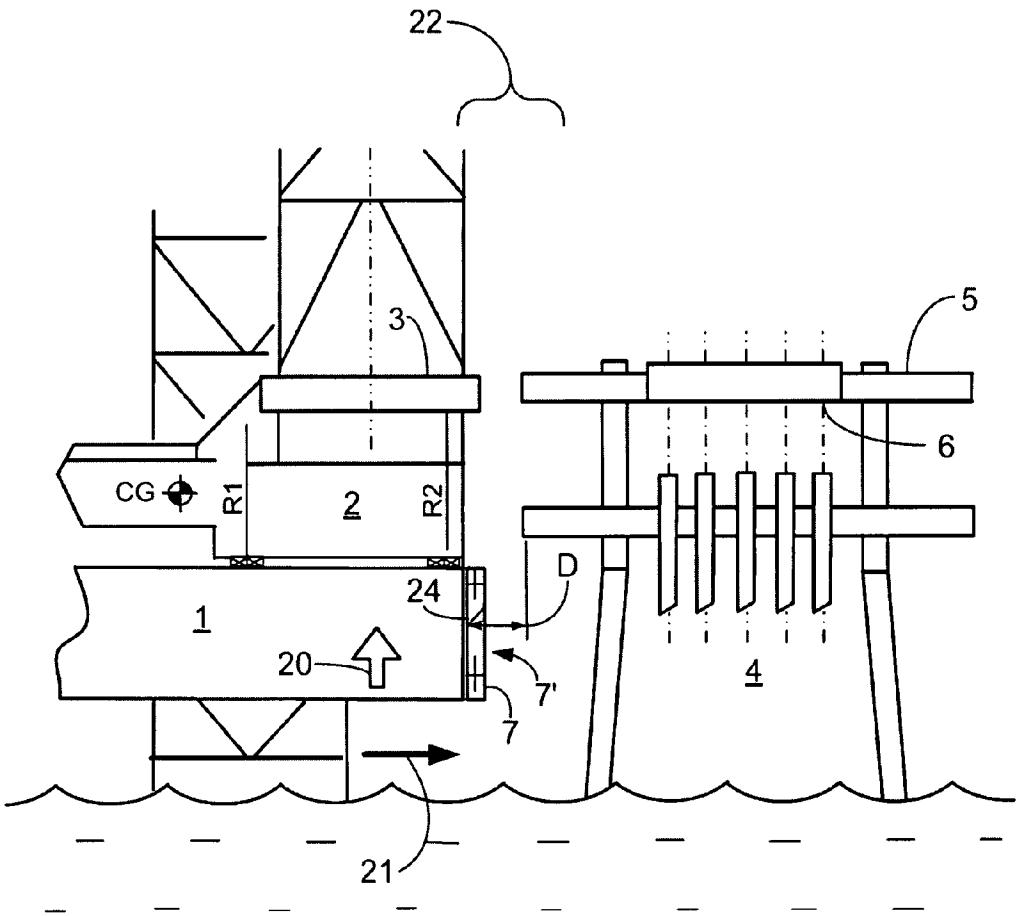
FIG. 1 is an elevation view of the self elevating drilling unit or jack-up vessel alongside a platform ready to elevate into working position for a drilling program over the jacket.
Figure 2:
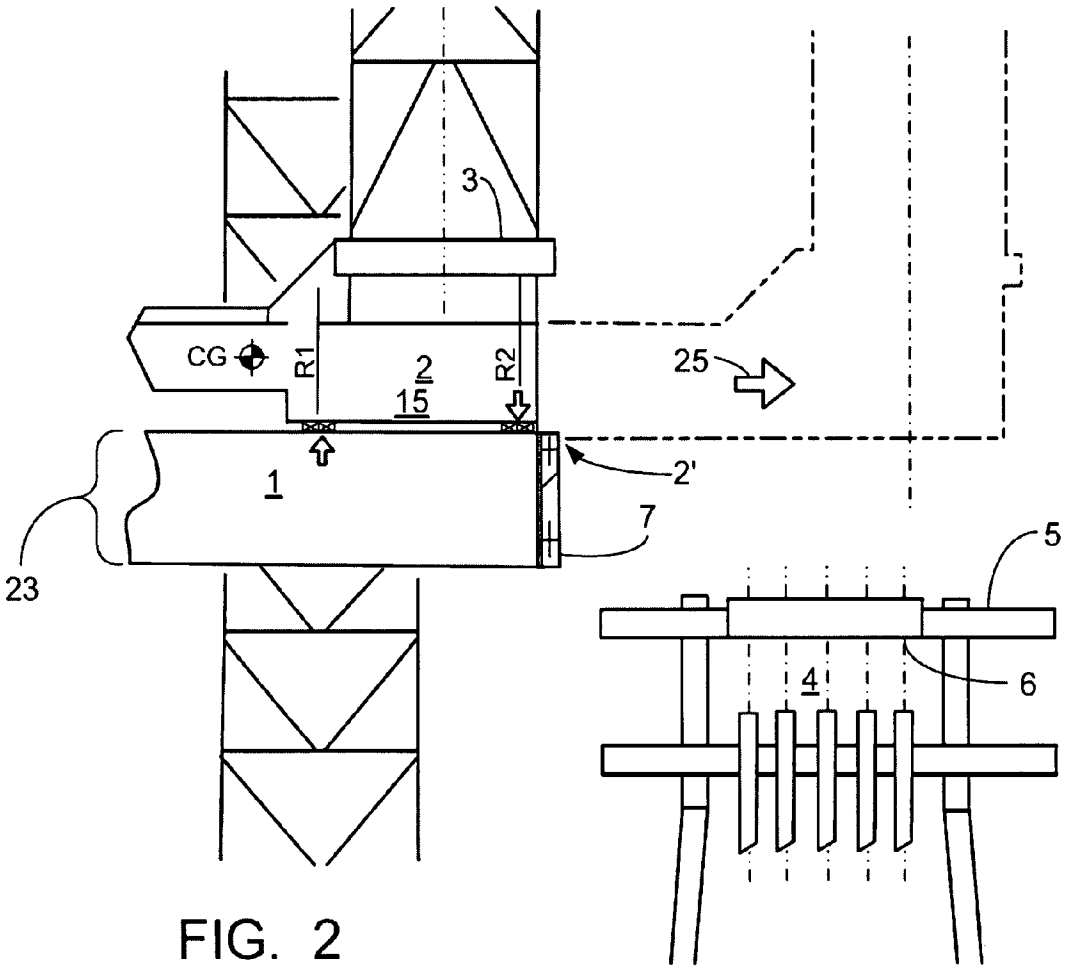
FIG. 2 is an elevation view of the self elevating drilling unit or jack-up vessel elevated next to the platform jacket ready to deploy its cantilever beam and drill floor above the drilling template.

Referring to FIGS. 1 and 2, a self elevating drilling unit comprising, for example, a jack up vessel 1 (also known as a jack up rig) is positioned 21 (for example, 5-10 feet, with the distance varying depending upon operator skills, soil, the vessel deployed, etc) so as to be situated adjacent 22 to a platform jacket 4, then elevated 20 to working position 23. First 7 and second 7' reaction frames associated with the stern of the vessel are shown in their retracted 24 position, said frames mounted at the transom 11 of the jack up vessel 1.

As shown, in the retracted position 24, the reaction length of each of the frames is pivoted so that the length of each frame is situated adjacent to the transom, providing a storage position requiring minimal space.

A minimum distance "D" is kept between the jack up vessel 1 and the platform 4, this proximity is required for the cantilever and drill floor to reach out an adequate distance to the drilling template 6, once the platform is elevated above the platform deck 5. As shown, the reaction frames 7, 7', being situated in their retracted position, allows the jack up vessel 1 to be positioned within the minimum distance "D" required.

Continuing with FIG. 2, the jack up vessel 1 is shown in its working position 23 elevated above the platform deck 5. The retractable stern reaction frames 7, 7' remain in their stowed position, and thus do not support the cantilever at this point.

The cantilever 15, formed by first 2 and second 2' longitudinally aligned beams, supporting drill floor 3 are shown stowed, ready to be deployed, and the broken lines show the outline of the cantilever 15 and drill floor 3 at working position where the arrow 25 shown within indicates the deployment movement direction.

In this traditional scenario, (i.e., without the added support of the reaction frames 7, 7' of present invention), the cantilever beams 2, 2' transmit the load to the jack up vessel 1, predominantly at points R1 and R2. R1 has a hold down H/D effort where the cantilever beam is pushing upward under load. R2 has a push up effort where the cantilever beams are bearing down under load. Accordingly, R1 & R2 generates a force couple that counteracts the overturning moment of the cantilever beam 2, 2'.

Figure 3:
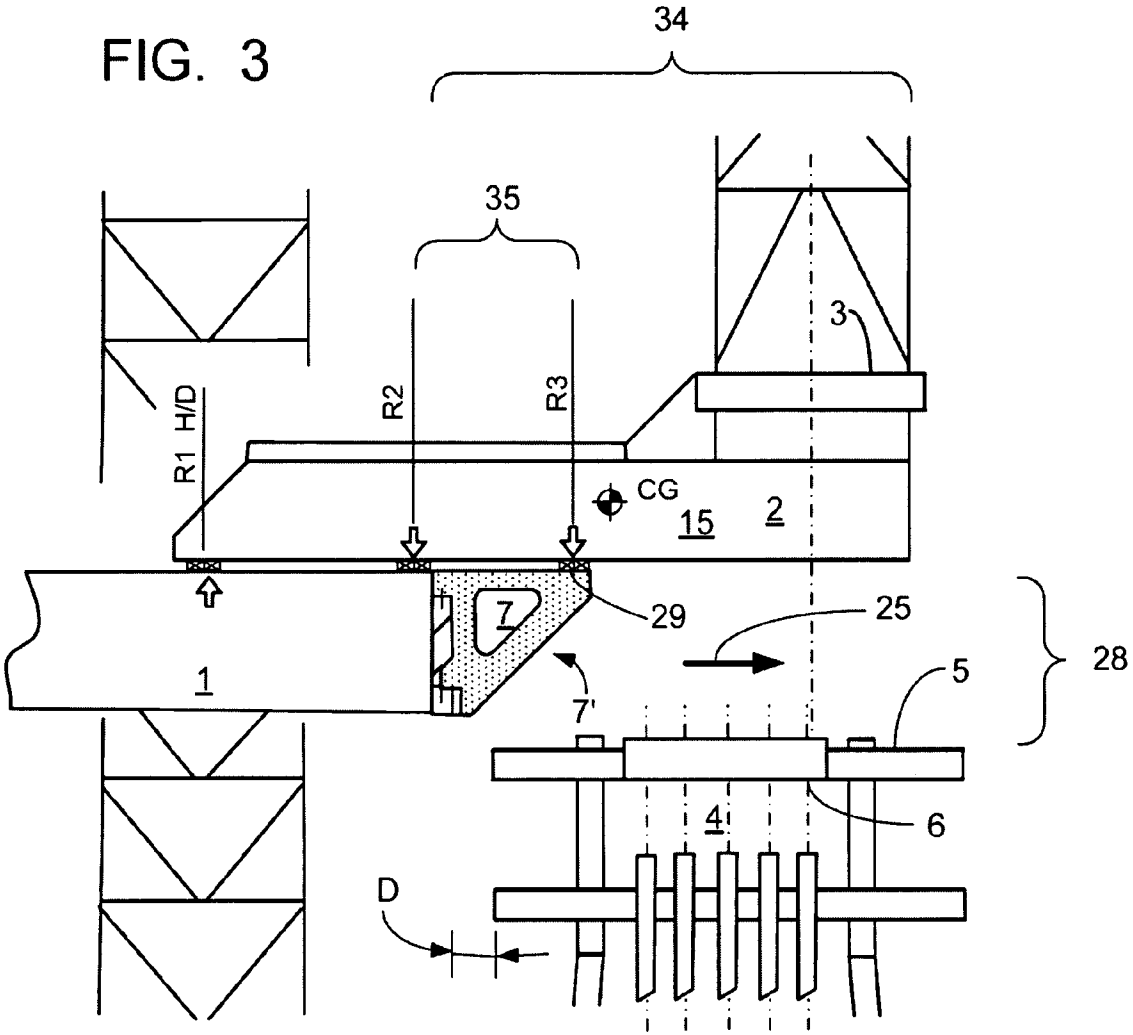
FIG. 3 is an elevation view of the self elevating drilling unit deployed over the platform jacket ready to drill.
Figure 4:
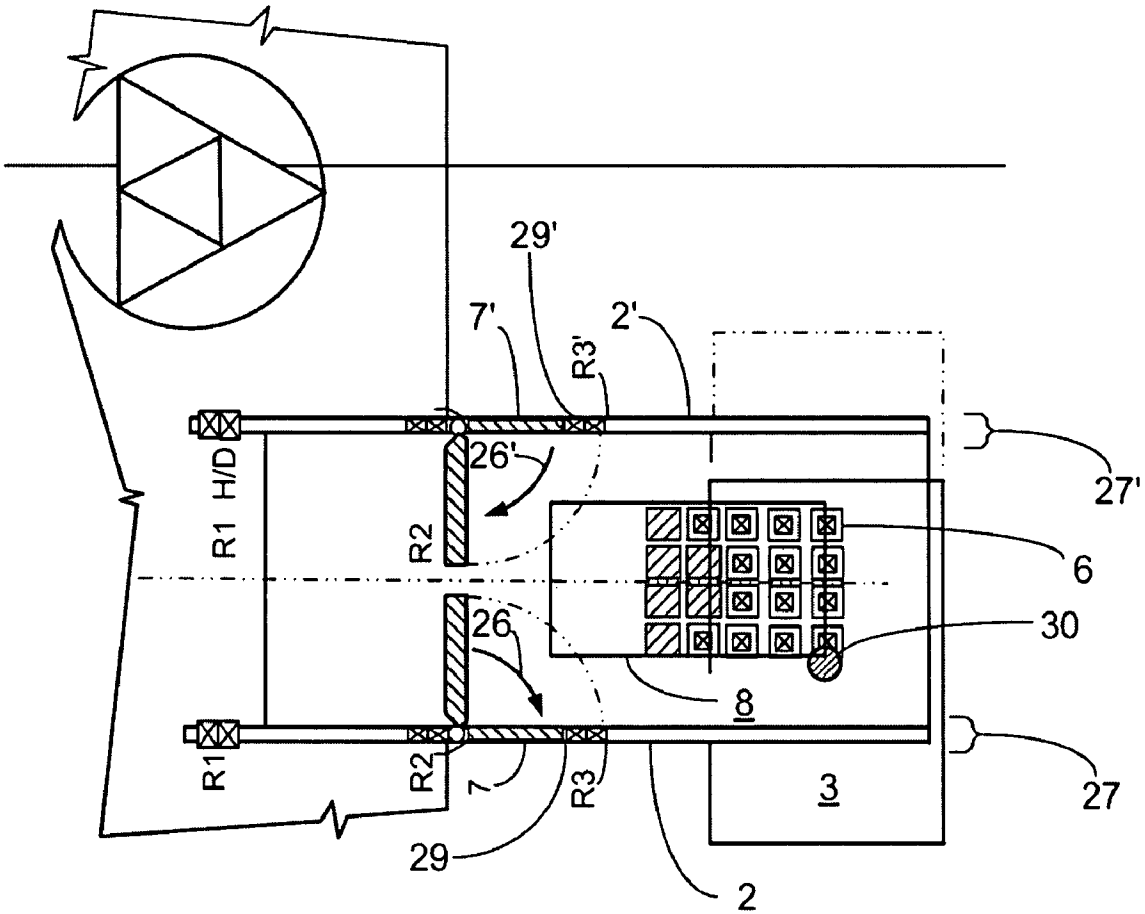
FIG. 4 is a plan view of the self elevating drilling unit at the drilling template elevation with projected outline of cantilever and drill floor shown.

Continuing with FIGS. 3 and 4, cantilever 15 and the drill floor 3, elevated above the platform deck 5, may now be deployed 25 into their extended, working position (for example, cantilever extending 20-25 feet above platform), situated in spaced 28 relation above the drilling template 6. The reaction frames 7, 7' are pivoted 26, 26' from their stored position, with their length adjacent to the transom, to their deployed 27, 27' position, wherein their length is generally transverse the transom, so as to extend added support surfaces 29, 29', to the cantilever beams 2, 2' at support points R3 and R3', respectively.

Those support points R3, R3' project significantly outward of the transom, ideally, for example, approximately one third 35 of the cantilever beam working envelope 34, so as to increase the distance between the reaction points, as well as to generate a more effective force couple, so as to sustain the overturning moment of the cantilever beam 2. As earlier indicated, partial load reaction can be obtained by designing the reaction frames (i.e., auxiliary structure) to share the cantilever beam loading, once a certain, level of deflection has being reached. Partial reaction can be computed for any given support arrangement, where the relation between deflection and load is proportional.

The present invention thereby provides an innovative support arrangement unlike any prior art on a self elevating drilling unit, and defines the basics of the present invention.

FIG. 4 shows a plan view at the main deck level of the jack up vessel 1, the drilling template 6 of the platform 4 (FIG. 3) is also shown as an indication, and the cantilever beams 2, 2' and drill floor 3 outlines are also shown. The drilling envelope 8 sets forth the boundaries wherein the well center 30 can be positioned. The illustration also shows the drill floor 3 skidded to port side and the cantilever 15 to its maximum outreach, overlaid over the drilling template 6.

The drilling template 6 comprises many ports for well to be drilled through, the shaded ports show the boundary where the cantilever 15 can drill with full rated load under conventional support arrangement (without the use of the reaction frame of the present invention), beyond this limit the rating is reduced.

Once again, an important feature of the present invention is that the reaction frames 7, 7' are stowable into a compact storage position allowing the vessel to be positioned within the minimum distance D (for example, 5-10 feet, depending upon soil conditions and operator skills) and be raised to the appropriate position for extending of the cantilever above the drilling template 6. (as shown in the above discussed FIGS. 1 and 2).

Further, as shown in FIGS. 3 and 4, the reaction frames 7, 7', once in their deployed, extended position to support the cantilever, said reaction frames extend beyond the minimum distance D for lowering the vessel (as said deployed frames would collide with the underlying platform if the vessel is lowered below the platform level), and therefore said reaction frames must be re-stowed (as shown via pivoting 26, 26', at the first end of each frame, so that each frame is adjacent to the transom) prior to lowering of the drilling unit.

FIGS. 5A and 5B shows sample load charts, FIG. 5A indicating exemplary loads before modification, and FIG. 5B after modification). With a conventional support arrangement (i.e., cantilever without added support, as shown on 5A, only 45 percent of the envelope is rated at full load (100%), where the extremities are reduced to 26 percent of the load rating.

After modification, with the auxiliary stern reaction frames, as shown on 5B, the full load rating can be maintain nearly the entire drilling envelope, 90 percent, and the extremities are reduced to 76 percent only.

Figure 6:
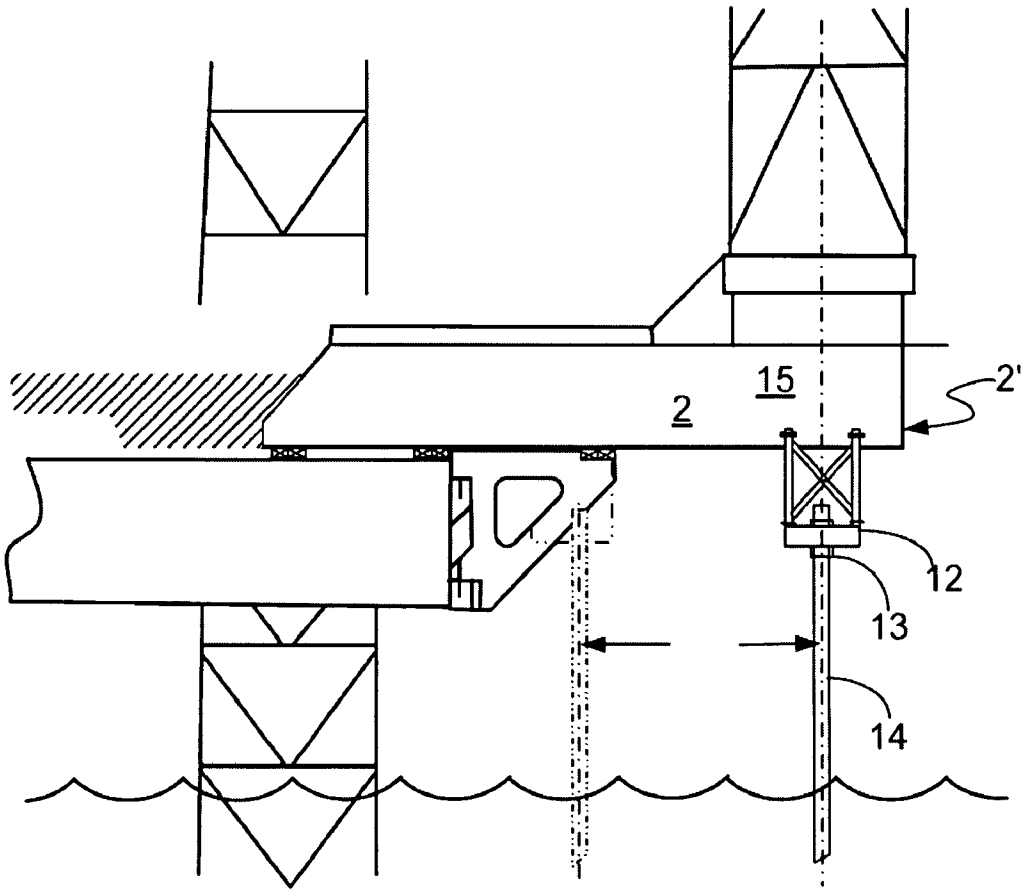
FIG. 6 is an elevation view that shows the self elevating unit or jack-up vessel on an exploration well scenario at an open location.
Figure 7:
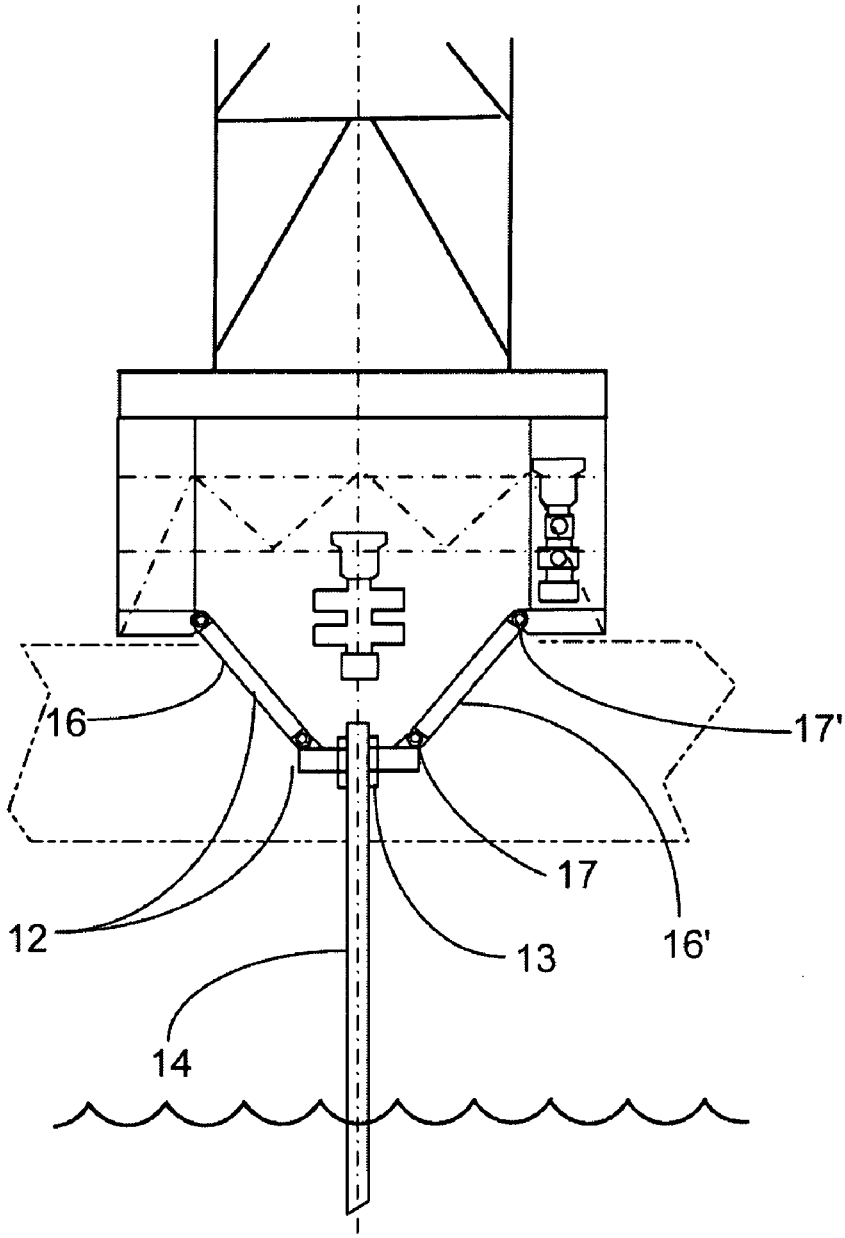
FIG. 7 shows a section view of the cantilever beam showing more details on the conductor tensioning method for exploration wells.

As shown in FIGS. 6 and 7, an exemplary system for tensioning the conductor pipe utilizes first 16 and second 16' tension members, each having first 17 and second 17' ends, the first ends 17 engaging the tensioning unit, the second ends 17' engaging cantilever beams 2, 2', respectively. This concept shows a portable support structure 12 for the tensioning unit 13 which stabilizes the conductor 14 in an open water location under load from sea current and waves.

Figures 8A, 8B, 8C, 8D:
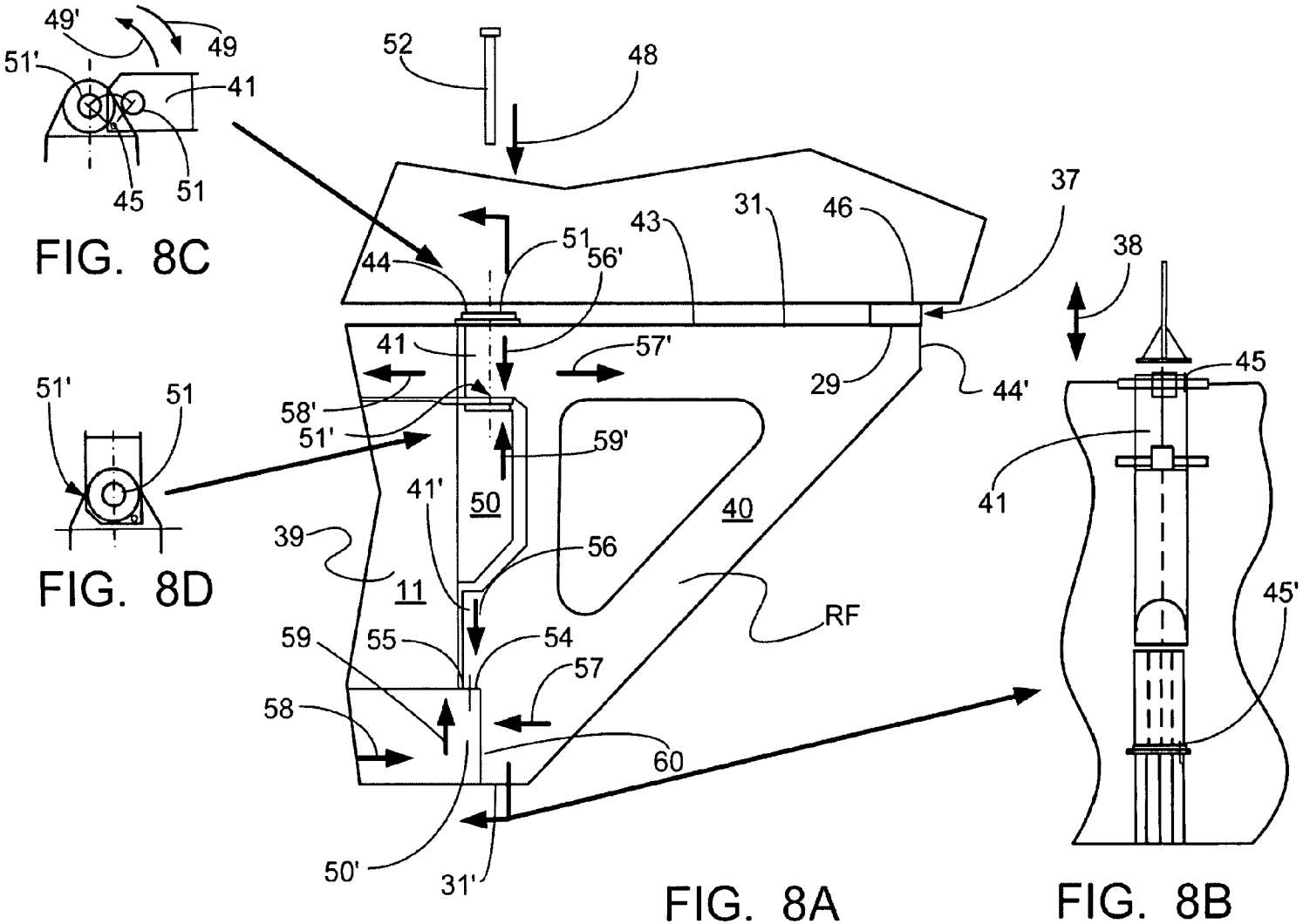
FIG. 8A illustrates a close, up, side view of the reaction frame of the present invention as pivotally attached to the stern of a vessel via mounting bracket, supporting a deployed cantilever.
FIG. 8B is an end view of the reaction frame of FIG. 8A.
FIG. 8C is a top view of the reaction frame of FIG. 8A.
FIG. 8D is a bottom view of the reaction frame of FIG. 8A.

FIGS. 8A-8C illustrate an exemplary reaction frame configuration suitable for reaction frames 7, 7' discussed earlier in the application. As shown, the reaction frame RF comprises a body 40 having an upper edge 43 having first 44 and second 44' ends, a top 31 and a bottom 31', the first end having formed therein upper 41 and lower 41' mounts, said mounts formed to selectively engage upper and lower base supports 50, 50', respectively. Said base supports emanate from, or are otherwise securely anchored to, the vessel (in this example, the transom of the vessel). Preferably, the upper and lower base supports 50, 50' are securely integrated through the transom to the bulkhead(s) 39 (which may be further reinforced for increased load bearing and distribution) of the vessel, so as to distribute the load to the structure of the vessel. In drilling units, in general there is a bulkhead inline with the cantilever beams connecting to the transom, which said base supports may integrate with through the transom, so that the load supported by the reaction frames would be transferred to the transom and longitudinal bulkhead simultaneously.

The upper 41 mount and lower 41' mounts pivotally engage the upper and lower base supports 50, 50' via pivot pins 45, 45', respectively, so as to allow the reaction frame to be pivotally 49, 49' supported by the vessel. It is noted that the pivot pins 45, 45' are not designed to support the reaction frame when in use (i.e., the pivot pins in the present configuration are not configured to support added load); rather, the pivot pins are intended for use during storage and deployment, i.e., for pivoted each reaction frame to and from the storage position, as well as retaining each reaction frame in a storage position, adjacent to the transom or other location on the vessel or structure Formed through the upper mount 41 of the reaction frame and the primary base support 50 on the vessel are bores 51, 51', respectively, said bores formed in a fashion such that, when the reaction frame RF is pivotally 49' positioned at its deployed position relative to the transom (as shown in FIG. 8A), the bores are in axial alignment 53 (specifically, bore 51 is positioned so as to align with bore 51'), so as to receive a load pin 52 therethrough, further, the upper mount 41 is positioned above the upper base support, for support therefrom, while the lower mount 41' is positioned above and supported by the lower base support 50', thereby placing the reaction frame in an engaged, load bearing configuration with regard to the upper and lower base supports 41, 41', and the load pin, such that load on the support surface 29 is transferred through upper 41 and lower 41' mounts to upper 50 and lower 50' base supports, respectively, which load passes on to the vessel.

Because of the incidence of the reaction frame with the bearing surfaces, the load pins are not particularly envisioned for use as a pivot, but rather to place the configuration into a load bearing configuration. Furthermore, to suit specific needs, the load pins may be engineered to have a profile other than cylindrical so as to resist pivoting.

When mounted in the deployed configuration, above, the lower base support 50' receives loads from the reaction frame transmitted via two forces; the horizontal load 56 and the vertical 57 load, which are met with horizontal 58 and vertical 59 reaction efforts from the hull via bearing surfaces 60, 54. Likewise, the upper base support 50 receives loads from the reaction frame transmitted via two forces, the horizontal 56' load and the vertical 57' load, which are met with horizontal 58' and vertical 59' reaction efforts from the hull via the installed 48 pivot pin 52 and upper base support 50. The framework is thereby designed to transmit the reaction forces back to the main deck, cantilever support bulkheads, inner bottom and bottom structure.

An attribute or appendage 55 associated with the lower base support 50' is shown as well, and depending on the loading, this appendage also can be used to transmit some of the vertical load by providing vertical support to the lower mount 41' at bearing surface 54.

In the preferred embodiment of the present invention, the pivot points are auxiliary and are positioned off center and separate from the load pin, for space conservation, as well as to provide a better incidence between the 2 bearing surfaces at the bottom, where the pivot point is offset from the 2 bearing surfaces (similar to a hinge mechanism).

As earlier indicated, the second end 44' of the reaction frame is provided with support surface 29. The support surface may include a raised engagement portion 46 which may be formed into the body, or may comprise a separate component, which may be adjustable as to height (i.e., vertically 38 adjustable via threaded engagement 37, for example) or location on the upper edge 43, the support surface formed to engage the underside of the cantilever beam(s), or otherwise engage and support the cantilever structure.

The engagement portion 46 may comprise a bearing surface of, for example, bronze, to provide low friction and corrosion resistance. The engagement portion (also may be referenced as a load pad) ideally will be adjustable to account for cantilever beam deflection under its own weight. A tapered bearing housing mounted on a slope may be provided for this purpose, which bearing housing may be selectively lockable at different positions to adjust the cantilever beam underside.

While the preferred embodiment of the auxiliary support structure of the present invention is shown as pivotal from a stowed to a deployed position, this pivotal operation is shown only as an example, and is not intended to be limiting. For example, other auxiliary support structures may also work in suitable fashion to accomplish the goals of the present invention which could comprise, for example, quick mount units engaging mounting brackets on the transom or other portion of the vessel which may be mounted prior to deploying the cantilever beam, and removed after retracting the cantilever beam, as required.

Further, mechanical devices may be utilized to position the reaction frames, adjust the raised engagement portion 46, or to install or remove the load pins into the system, as required.

LIST OF ELEMENTS

Description
R1 point
R2 point
R3 support points
1 vessel
1 jack up vessel
2 cantilever beam
3 drill floor
4 platform jacket
4 platform
5 platform deck
6 drilling template
7,' first and second stern reaction frames
8 drilling envelope
9 load charts before modification
10 "after modification
11 transom

12 portable support structure
13 tensioning unit
14 conductor
15 cantilever structure
16, 16' first, second conductor tensioning members
17 first second ends
18
19
20 elevated
21 positioned
22 adjacent to
23 working position
24 retracted/stowed
25 deployed cantilever
26 pivoted
27,' deployed support/reaction frame
28 above
29,' support surface
30 well center
31, 31' top, bottom
32,'
33,'
34 cantilever beam working envelope
35 distance support point 29 is projected by reaction frame (Example about ⅓ 34)
36
37 threaded engagement
38 vertically adjustable
39 bulkhead
RF Reaction frame
40 body
41,' upper, lower mounts
42 support surface
43 upper edge
44,' first, second ends
45 pivot pin
46 raised engagement portion
47 upper, lower support members
48 installed
49 pivot
50,' upper, lower base supports
51,' longitudinally aligned bores
52 load pin
53 axial alignment
54 bearing surface
55 appendage
56 horizontal load
57 vertical load
58 horizontal reaction effort
59 vertical reaction effort
60 bearing surface The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. An apparatus for supporting a cantilever assembly extending from a self-elevating drilling unit, comprising:

a reaction frame attached to and extendable from said drilling unit, said reaction frame formed to support said extended cantilever assembly by transferring load from the underside of said cantilever assembly to the structure of said self-elevating drilling unit;

wherein, upon said self-elevating drilling unit being positioned within a minimum approach distance with regard to a platform, said reaction frame is formed to selectively extend and support said extended cantilever assembly beyond said minimum approach distance; and wherein said reaction frame is formed to be repositioned to a stowed position adjacent to said drilling unit, and wherein said stowed position is formed to situate said reaction frame within said minimum approach distance.

2. The structure of claim 1, wherein said reaction frame has first and second ends, and wherein said support member is formed so as to be selectively extendable from said drilling unit from a stowed position, wherein said first and second ends are situated adjacent to said drilling unit, said reaction frame being further formed so as to be positionable to a deployed, extended position, wherein said first end is adjacent to said drilling unit, and said second end of said support member is formed to engage and support said cantilever over said platform.

3. The structure of claim 2, wherein said drilling unit has a transom, and wherein said reaction frame pivotally engages said transom of said drilling unit.

4. The structure of claim 2, wherein said drilling unit has a longitudinal bulkhead, and said reaction frame engages said longitudinal bulkhead of said drilling unit.

5. The structure of claim 3, wherein there is further provided an upper base support emanating from said drilling unit engaging said reaction frame, said upper base support engaging a bulkhead associated with said drilling unit.

6. The structure of claim 5, wherein said reaction frame pivotally engages said upper base support via a first pivot pin.

7. The structure of claim 6, wherein there is further provided a lower base support situated under said upper base support, and wherein said reaction frame pivotally engages said lower base support via a second pivot pin.

8. The structure of claim 5, wherein said reaction frame has formed therein an upper support member, and wherein said upper support member and said upper base support are formed to receive a common load pin when said support member is in said deployed position, so as to facilitate transfer of load from said extended cantilever and through upper base support, via said reaction frame and said upper support member.

9. The structure of claim 8, wherein said upper support member and said upper base support each have a bore formed therethrough for receiving said load pin, said bores of said tipper base support and said upper support member being formed so as to be aligned to receive said load pin, when said reaction frame is in said deployed position.

10. The structure of claim 9, wherein said cantilever has a length, and said reaction frame has a support surface in the vicinity of said second end of said reaction frame.

11. The structure of claim 10, wherein said reaction frame is formed to engage the underside of said extended cantilever, at least 25% of the distance said extended cantilever extends from said drilling unit.

12. The structure of claim 11, wherein said second end of said reaction frame comprises a raised engagement portion formed to engage the underside of said engaged cantilever when said reaction frame is deployed.

13. The structure of claim 12, wherein said raised engagement portion is vertically adjustable.

14. An apparatus for supporting a cantilever extending from a drilling unit above a platform, said drilling unit having a bulkhead, comprising:

a reaction frame engaged to said drilling unit so as to be extendable from said drilling unit, said reaction frame formed provide underlying support to said extended cantilever at least 25% of the distance said cantilever extends from said drilling unit, said reaction frame selectively from a storage position adjacent to said drilling unit, to a deployed, cantilever-supporting position under said cantilever, wherein one end of said reaction frame engages said drilling unit, while another end extends from said drilling unit below said cantilever, to provide a support point for said cantilever extended away from said drilling unit and situated above said platform, said reaction frame formed to transfer load from said cantilever, at said support point, to the bulkhead of said drilling unit.

15. The apparatus of claim 14, wherein, upon said drilling unit being positioned within a minimum approach distance with regard to a platform, said reaction frame is formed to selectively extend and support said extended cantilever assembly beyond said minimum approach distance.

16. The structure of claim 15, wherein said reaction frame, in said stored position adjacent to said drilling unit, is formed to situate said reaction frame within said minimum approach distance.

17. The structure of claim 16, wherein said reaction frame has first and second ends, and wherein said support member is formed so as to be selectively extendable from said drilling unit from a stowed position, wherein said first and second ends are situated adjacent to said drilling unit, said reaction frame being further formed so as to be positionable to a deployed, extended position, wherein said first end is adjacent to said drilling unit, and said second end of said support member is formed to engage and support said cantilever over said platform.

18. The structure of claim 17, wherein said drilling unit has a transom, and wherein said reaction frame pivotally engages said transom of said drilling unit.

19. The structure of claim 17, wherein said bulkhead of said drilling unit is a longitudinal bulkhead, and wherein said reaction frame engages said longitudinal bulkhead of said drilling unit.

20. The structure of claim 18, wherein there is further provided an upper base support emanating from said drilling unit engaging said reaction frame, said upper base support engaging said bulkhead of said drilling unit.

21. The structure of claim 20, wherein said reaction frame pivotally engages said upper base support via a first pivot pin.

22. The structure of claim 21, wherein there is further provided a lower base support situated under said upper base support, and wherein said reaction frame pivotally engages said lower base support via a second pivot pin.

23. The structure of claim 19, wherein said reaction frame has formed therein an upper support member, and wherein said upper support member and said upper base support are formed to receive a common load pin when said support member is in said deployed position, so as to facilitate transfer of load from said extended cantilever, through upper base support via said reaction frame and said upper support member.

24. The structure of claim 23, wherein said upper support member and said upper base support each have a bore formed therethrough for receiving said load pin, said bores of said upper base support and said upper support member being formed so as to be aligned to receive said load pin when said reaction frame is in said deployed position.

25. The structure of claim 24, wherein said cantilever has a length, and said reaction frame has a support surface in the vicinity of said second end of said reaction frame.

26. The structure of claim 24, wherein said second end of said reaction frame comprises a raised engagement portion formed to engage the underside of said engaged cantilever when said reaction frame is deployed.

27. The structure of claim 26, wherein said raised engagement portion is vertically adjustable.

28. An apparatus for supporting an extended cantilever from a drilling unit having a transom and a bulkhead, comprising: a selectively deployable reaction frame having first and second ends, said first end engaging said bulkhead of drilling unit, said second end formed to selectively extend from said drilling unit and engage the underside of said extended cantilever at least 25% of the distance said cantilever extends from said drilling unit, so as to transpose vertical efforts associated with said extended cantilever to said drilling unit via said transom;

wherein said dnllin unit has a transom and wherein said reaction frame pivotally engages said transom of said drilling unit.

29. The structure of claim 28, wherein bulkhead of said drilling unit comprises a longitudinal bulkhead, and said reaction frame engages said longitudinal bulkhead of said drilling unit.

30. The structure of claim 28, wherein there is further provided an upper base support emanating from said drilling unit engaging said reaction frame, said upper base support engaging said bulkhead associated with said drilling unit.

31. The structure of claim 30, wherein said reaction frame pivotally engages said upper base support via a first pivot pin.

32. The structure of claim 31, wherein there is further provided a lower base support situated under said upper base support, and wherein said reaction frame pivotally engages said lower base support via a second pivot pin.

33. The structure of claim 32, wherein said reaction frame has formed therein an upper support member, and wherein said upper support member and said upper base support are formed to receive a common load pin when said support member is in said deployed position, so as to facilitate transfer of load from said extended cantilever, through upper base support via said reaction frame and said upper support member.

34. The structure of claim 33, wherein said upper support member and said upper base support each have a bore formed therethrough for receiving said load pin, said bores of said upper base support and said upper support member being formed so as to be aligned to receive said load pin when said reaction frame is in said deployed position.

35. The structure of claim 34, wherein said cantilever has a length, and said reaction frame has a support surface in the vicinity of said second end of said reaction frame.

36. The structure of claim 35, wherein said second end of said reaction frame comprises a raised engagement portion formed to engage the underside of said engaged cantilever when said reaction frame is deployed.

37. The structure of claim 36, wherein said raised engagement portion is vertically adjustable.

38. A method of supporting a portion of a cantilever extending from a drilling unit, comprising the steps of:

a. providing a support assembly, comprising:

i. a reaction frame having an upper portion having first and second ends and a length, said length having situated thereon a support portion formed to providing underlying support to a portion of said cantilever assembly;

ii. a mount engaging said structure;

iii. said reaction frame pivotally engaging said mount such that said reaction frame is selectively deployable from a stowed position to an extended, supporting position;

b. positioning said drilling unit within the vicinity of a platform;

c. raising said drilling unit;

d. positioning said reaction frame from said stowed position to said extended, supporting position;

e. extending a portion of said cantilever from said drilling unit to above said platform;

f. allowing said support portion of said reaction frame to engage and provide underlying support to said cantilever above said platform.

39. The method of claim 38, wherein in step "d" said first end of said reaction frame is pivoted so as to extend said second end of said reaction frame away from said drilling unit.

40. The method of claim 39, wherein in step "d" there is provided the additional step "d1" of inserting a common load pin into said reaction frame and said mount, and in step "f" there is further provided the step "f1" utilizing said load pin to facilitate load transfer from said reaction frame to said drilling unit, via said mount.

41. The method of claim 40, wherein in step "a" there is provided the additional steps of forming a first bore in said reaction frame, and forming a second bore in said mount support, such that said bores of reaction frame and said mount are aligned to receive said load pin when said reaction frame is in said deployed position.

42. The method of claim 40, wherein in step "a" said second end of said reaction frame comprises a raised engagement portion, and in step "f1" there is further provided the additional step "F2" of vertically adjusting said raised engagement portion to engage and support the underside of said cantilever above said platform.

43. A method of supporting a cantilever extending from a drilling unit, in which the extended portion of said cantilever is subjected to a load, comprising the steps of a. providing a support member attached to and selectively deployable from a stowed position adjacent to said drilling unit to an extended position extending from said drilling unit;

b. placing said support member in an extended position to engage the underside of said cantilever, so as to transfers a portion of said load to said drilling unit, such that an area of the extended portion of said cantilever rated at full load capacity when not supported by said support member is increased by at least 40% capacity when engaged by said support member.

* * * * *